US009404347B1

(12) United States Patent
Bjerga et al.

(10) Patent No.: US 9,404,347 B1
(45) Date of Patent: Aug. 2, 2016

(54) APPARATUS AND METHOD FOR CONNECTING A RISER FROM AN OFFSHORE RIG TO A SUBSEA STRUCTURE

(71) Applicants: Kristofer K. Bjerga, Thibodaux, LA (US); Seth J. Fadaol, Youngsville, LA (US); Benny J. Vincent, Tiki Island, TX (US)

(72) Inventors: Kristofer K. Bjerga, Thibodaux, LA (US); Seth J. Fadaol, Youngsville, LA (US); Benny J. Vincent, Tiki Island, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/713,891

(22) Filed: May 15, 2015

(51) Int. Cl.

| | |
|---|---|
| ***E21B 17/01*** | (2006.01) |
| ***E21B 33/038*** | (2006.01) |
| ***E21B 43/013*** | (2006.01) |
| ***E21B 19/00*** | (2006.01) |

(52) U.S. Cl.
CPC ..... *E21B 43/013* (2013.01); *E21B 17/01* (2013.01); *E21B 19/004* (2013.01); *E21B 33/038* (2013.01)

(58) Field of Classification Search
CPC ..... E21B 17/01; E21B 33/038
USPC ..... 166/345, 367
See application file for complete search history.

(56) References Cited

U.S. PATENT DOCUMENTS

| | | | | |
|---|---|---|---|---|
| 3,265,130 | A * | 8/1966 | Watkins | 166/342 |
| 3,458,853 | A * | 7/1969 | Daniels et al. | 367/2 |
| 3,731,263 | A * | 5/1973 | Daniels et al. | 367/2 |
| 4,031,544 | A * | 6/1977 | Lapetina | B63C 11/48 166/341 |
| 4,351,027 | A * | 9/1982 | Gay | E21B 41/0014 114/144 B |
| 4,624,318 | A * | 11/1986 | Aagaard | E21B 7/128 166/359 |
| 5,875,848 | A * | 3/1999 | Wolff et al. | 166/345 |
| 5,978,739 | A * | 11/1999 | Stockton | 702/6 |
| 6,343,655 | B1 * | 2/2002 | Thomas | 166/343 |
| 6,588,985 | B1 * | 7/2003 | Bernard | 405/191 |
| 7,066,686 | B2 * | 6/2006 | Sabri et al. | 405/158 |
| 7,080,689 | B2 * | 7/2006 | Guesnon et al. | 166/355 |
| 7,328,741 | B2 * | 2/2008 | Allen et al. | 166/64 |
| 7,389,818 | B2 * | 6/2008 | Hoiland | 166/367 |
| 7,416,025 | B2 * | 8/2008 | Bhat et al. | 166/355 |
| 7,798,232 | B2 * | 9/2010 | Headworth | 166/352 |
| 8,235,123 | B2 * | 8/2012 | Stokka et al. | 166/357 |
| 8,992,127 | B2 * | 3/2015 | Joensen et al. | 405/205 |
| 2007/0272414 | A1 * | 11/2007 | Palmer et al. | 166/367 |
| 2009/0056936 | A1 * | 3/2009 | McCoy, Jr. | 166/250.01 |
| 2015/0114656 | A1 * | 4/2015 | Rogers et al. | 166/339 |

* cited by examiner

*Primary Examiner* — Matthew R Buck
(74) *Attorney, Agent, or Firm* — Cantor Colburn LLP

(57) ABSTRACT

In one aspect, a method of connecting a riser from an offshore rig to wellhead equipment that includes a first connector is disclosed. The method, in one non-limiting embodiment, includes lowering a riser of sufficient length having a second connector at a lower end thereof adapted to connect to the first connector of the wellhead equipment, wherein the riser is in fluid communication with and is filled with the sea water; closing the riser proximate to the lower end of the riser after lowering the riser; displacing the sea water in the riser with a fluid that is heavier than the sea water to straighten the riser and the second connector; and connecting the second connector to the first connector.

17 Claims, 1 Drawing Sheet

APPARATUS AND METHOD FOR CONNECTING A RISER FROM AN OFFSHORE RIG TO A SUBSEA STRUCTURE

BACKGROUND

1. Field of the Disclosure

This disclosure relates to a subsea wellbore system and in particular to a system and methods for attaching a riser to a subsea wellhead equipment.

2. Background of the Art

Subsea wells (also referred to as wellbores or boreholes) for the production of oil and gas are drilled into subsea formations from an offshore rig (such as a vessel). Often, the water depth exceeds 5000 feet. A riser, a hollow large diameter (e.g., 12-20 inches) flexible longitudinal tubular member, is connected between drilling equipment on the offshore rig and the wellhead equipment installed on the sea floor above the wellbore. During installation, the riser is filled with the sea water. To drill the wellbore, a drill string including a drill pipe attached to a bottomhole assembly having a drill bit at end thereof is conveyed into the wellbore through the riser. During installation of the riser, if the underwater eddy currents are strong enough, they can deflect the riser from the vertical between the offshore rig and the wellhead, which can make it difficult or unfeasible to connect the bottom end of the riser to the wellhead equipment. It is known that in the Gulf of Mexico, relatively strong sustained loop eddy currents exist, often between 2000-4000 feet depth. Such currents have at times severely disrupted oil and gas drilling activities, one of the reasons being the inability to connect the riser to the wellhead equipment. Therefore, there is a need to provide apparatus and methods for connecting a riser from an offshore rig to wellhead equipment when the riser is deflected from a vertical under the water.

The disclosure herein provides apparatus and methods for connecting a riser from an offshore rig to a wellhead equipment when the riser is deflected from the vertical.

SUMMARY

In one aspect, a method of connecting a riser from an offshore rig to a wellhead equipment placed on a sea bed is disclosed, wherein the wellhead equipment includes a first connector thereon. The method, in one non-limiting embodiment, includes lowering a riser of sufficient length having a second connector at a lower end thereof that is configured to connect to the first connector of the wellhead equipment, wherein the riser is in fluid communication with and is filled with the sea water (first fluid); closing the riser proximate to the lower end of the riser after lowering the riser; displacing the first fluid in the riser with a second fluid that is heavier than the first fluid to straighten the riser and the second connector; and connecting the second connector at the lower end of the riser to the first connector of the wellhead equipment.

In another aspect, an apparatus for connecting a riser from an offshore rig to a wellhead equipment is disclosed that includes a first connector thereon. The apparatus, in one non-limiting embodiment, includes a riser of sufficient length having a second connector at a lower end thereof configured to connect to the first connector of the wellhead equipment, wherein the riser is lowered from the offshore rig toward the connector of the wellhead equipment and is filled with the sea water; a plug closing the riser at a selected location in the riser; and a tubular inside the riser for supplying a fluid heavier than the sea water to displace the sea water in the riser with the heavier fluid.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally represented by same numerals and wherein.

DETAILED DESCRIPTION OF THE DRAWINGS

Figure 1:
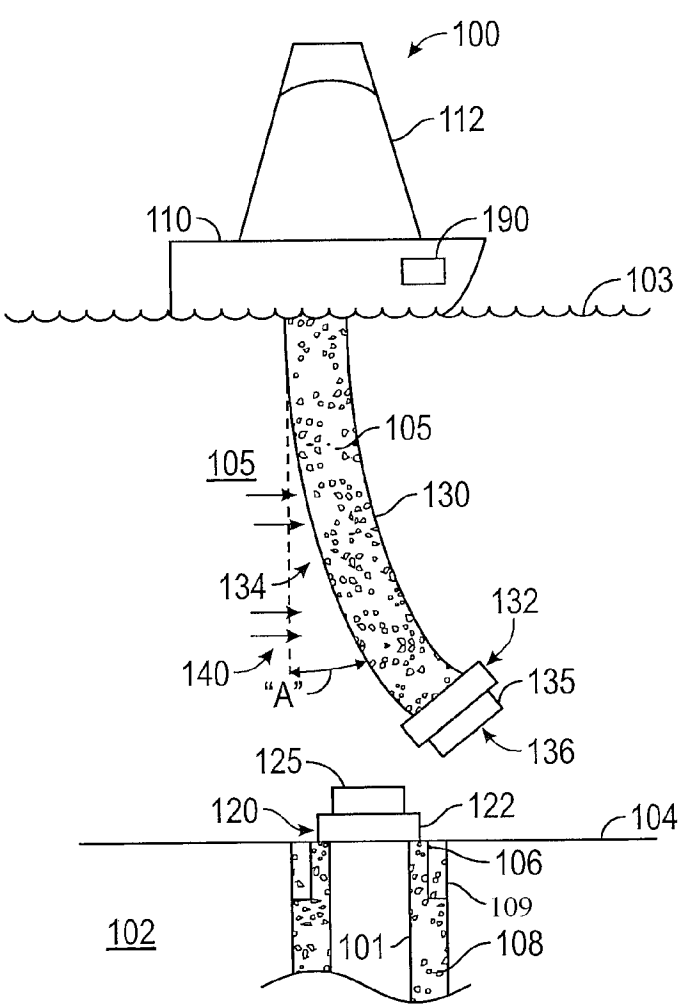
FIG. 1 shows an exemplary offshore oil well system that includes an offshore rig, wellhead equipment and a riser between the offshore rig and the wellhead equipment, wherein the riser has been deflected from the vertical to an extent that makes it impractical to connect the riser to the wellhead equipment.

FIG. 1 shows an exemplary offshore well system 100 for performing wellbore operations, including, but not limited to drilling and completion operations. FIG. 1 shows an exemplary offshore rig, such as a ship or vessel 110 or another maneuverable structure, carrying a rig 112 for performing various wellbore operations, stationed at the sea surface 103. Wellhead equipment 120, such as a x-mas tree including a blow-out preventor 122, is shown placed above a wellbore 101 formed in a subsea formation 102. Cemented casings 106 and 108 with cement 109 are shown outside of the wellbore 101 to stabilize the earth formation below the sea floor 104 to selected depths. The wellhead equipment 120 includes a connector 125 to which a riser 130 may be connected as described below. The riser 130 includes at its bottom end 132 a connector 135 configured to mate with the connector 125 of the wellhead equipment 120. The riser 130 is typically a flexible hollow longitudinal member of relatively large diameter (typically between 12-20 inches). The riser 130 is open at the end 136 of the connector 135 and is thus in fluid communication and filled with the sea water 105. To perform a wellbore operation, the riser 130 with the connector 135 attached to its bottom end is lowered from the offshore rig 110 toward the connector 125 of the wellhead equipment 120. Since the riser is in fluid communication with the sea water 105, it is filled with the sea water during its deployment. When strong underwater currents 140 are present, they tend to bend or deflect the riser to an angle "A" such as shown at location 134 of the riser 130. If the deflection angle A is relatively large, it deflects the face 136 of the connector 135 to a relatively large angle that makes it difficult and in extreme cases not feasible for an operator to straighten the connector 135 to latch it onto the connector 125 of the wellhead equipment 120. An exemplary, non-limiting apparatus and method for connecting the deflected riser connector 135 to the stationary wellhead equipment connector 125 is described in reference to FIG. 2 below.

Figure 2:
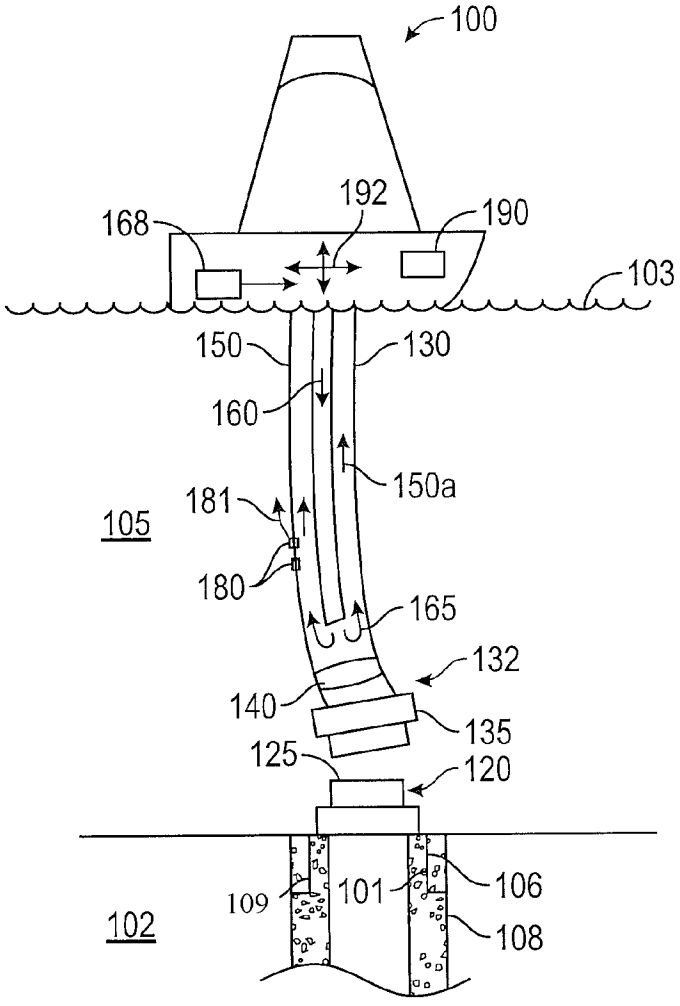
FIG. 2 shows the offshore oil well system of FIG. 1, wherein a tubular has been conveyed from the offshore rig into the riser, the riser has been plugged proximate to the bottom of the riser and a heavier fluid is replacing at least some of the sea water in the riser with a heavier fluid to straighten the riser to aid in connecting the riser to the well bore equipment.

FIG. 2 shows the offshore well system 100 of FIG. 1 in the process of straightening the riser 130 and thus the connector 135 for attachment with the connector 125 of the wellhead equipment 120. To straighten the riser 130 from the deflected position at location 134 in FIG. 1, a plug 140 is placed at a suitable or selected location in the riser 130, which may be proximate to the bottom end 132 of the riser 130. The plug 140 blocks or prevents fluid communication between the sea water 105 and the riser 130. The riser 130, however, remains filled with the sea water 105*a*. Any suitable plug known in the art may be utilized, including, but not limited to a packer and an inflatable bridge plug. An open ended tubular 150, such as a drill pipe, is conveyed from the rig 110 into the riser 130 to a suitable depth above the plug 140. A fluid 160 heavier than the sea water is supplied into the tubular 150 from the rig 110 by a supply unit 168, such as a pump unit, to cause a desired amount of the sea water 105*a* previously present in the tubular 150 and the space 155 between the tubular 150 and the riser 130 (also referred to as the annulus between the tubular 150 and the riser 130) to move to the surface as shown by arrows 165. As the heavier fluid 160 displaces the sea water 105*a*, the riser 130 starts to straighten. The extent to which and the speed at which the riser will straighten will depend upon the weight of the fluid 160 relative to the sea water weight and the supply rate of the fluid 160 into the riser 130. Thus, in aspects, the type and weight of the fluid may be selected based on the deflection of the riser 130 (computed or measured) from the vertical. Sensors 180 may be placed along the riser 130 to provide measurements for determining the deflection along the riser 130. The sensor data may be transmitted to a controller or processor 190 on the rig 110 via conductors 181 placed along the riser 130 or wirelessly. Any other method of monitoring the deflection of the riser 120 may also be utilized, including, but not limited to using surface measurements and using remotely-operated vehicles. The deflection along the riser 130 may be continuously monitored before, during and after the placement of the tubular 150 in the riser 130. The change in deflection may be monitored in-situ as the heavier fluid 160 is supplied into the tubular 150 to control the supply rate of the fluid 160. The extent of the deflection may be used to determine the type and density of the displacement fluid 160 and the supply rate. Once the connector 125 has been straightened to a desired extent, such as shown in FIG. 2, the vessel 110 may be maneuvered in any of the directions 192 while still monitoring the deflection to position the connector 135 above the connector 125. The vessel speed may be adjusted to limit the combined deflective force on the riser 130 below a selected limit for safe operations. Latching of the connector 135 to connector 125 may be accomplished by an operator sent underwater in an enclosed vehicle (not shown) and by maneuvering mechanical or robotic devices. Alternatively, attachment may be accomplished remotely from the surface by an operator and/or by the controller 190. Any other method of latching known in the art may be used for connecting the connectors 135 to connector 125. After connecting the riser to the subsea equipment, the tubular 150 and the plug 140 are removed from the riser.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of connecting a riser from an offshore rig to a subsea structure that includes a first connector, the method comprising:

lowering a riser of sufficient length having a second connector at a lower end thereof adapted to connect to the first connector of the subsea structure, wherein the riser is in fluid communication and filled with surrounding water ("first fluid");

closing the riser at a selected location, wherein closing the riser comprises placing a plug inside the riser to prevent fluid communication between the riser and water surrounding the riser;

displacing the first fluid in the riser with a second fluid that is heavier than the first fluid to straighten the riser to align the second connector with the first connector, wherein displacing the first fluid with the second fluid comprises:

conveying a hollow tubular from the offshore rig into the riser with a bottom end of the tubular extending to a selected location above the plug; and supplying the second fluid into the tubular to move a selected amount of the first fluid out of the riser to straighten the riser; and connecting the second connector to the first connector after conveying the hollow tubular and supplying the second fluid into the tubular to move the selected amount of the first fluid out of the riser.

2. The method of claim 1, wherein the second fluid is selected based on the density of the first fluid and deflection of the riser from vertical.

3. The method of claim 1, wherein connecting the second connector to the first connector comprises connecting the second connector to the first connector by a robotic device.

4. The method of claim 2, wherein the second fluid has a density greater than 9 lbs/gallon.

5. The method of claim 1, wherein the first connector is disposed on a wellhead equipment placed at sea floor that includes a blow-out preventor.

6. The method of claim 1, wherein the plug is selected from a group consisting of: (i) a packer; and (ii) an inflatable bridge plug.

7. The method of claim 1 further comprising maneuvering the offshore rig to position the second connector for latching the second connector to the first connector.

8. The method of claim 7, wherein maneuvering the offshore rig comprises limiting the speed of the offshore rig to limit deflection force on the riser below a selected value.

9. The method of claim 1 further comprising monitoring deflection of the riser.

10. The method of claim 9, wherein monitoring deflection of the riser is performed by one of: (i) utilizing at least one sensor associated with the riser and a controller that determines the deflection in response to the measurement made by the at least one sensor; (ii) a remotely-operated vehicle; and (iii) measurements made at a surface location.

11. An apparatus for connecting a riser from an offshore rig to wellhead equipment, wherein the wellhead equipment includes a first connector thereon, the apparatus comprising:

a riser of sufficient length having a second connector at a lower end thereof, wherein the riser is lowered from the offshore rig toward the first connector of the wellhead equipment and wherein the riser is filled with a first fluid;

a plug closing the riser at a selected location in the riser; and a tubular inside the riser for supplying a second fluid heavier than the first fluid into the riser to displace the first fluid from the riser and straighten the riser to align the second connector with the first connector, wherein the riser is configured to connect to the first connector of the wellhead equipment after displacing the first fluid from the riser with the second fluid via the tubular.

12. The apparatus of claim 11 further comprising a system for in-situ monitoring of deflection of the riser.

13. The apparatus of claim 12, wherein the system for in-situ monitoring the deflection of the riser includes at least one sensor placed along the riser for providing measurements relating to deflection of the riser.

14. The apparatus of claim 13 further comprising a controller that determines the deflection of the riser from the measurements provided by the at least one sensor.

15. The apparatus of claim 12, wherein the system of in-situ monitoring the deflection of the riser includes one of: (i) a surface measurement unit; and (ii) a remotely-controlled vehicle.

16. The apparatus of claim 11 further comprising a pump unit at the offshore rig for supplying the second fluid into the tubular.

17. The apparatus of claim 11, wherein a controller controls supply of the second fluid based on in-situ monitoring of deflection of the riser.

* * * * *